US011822273B2

(12) United States Patent
Kikuchi et al.

(10) Patent No.: US 11,822,273 B2
(45) Date of Patent: Nov. 21, 2023

(54) FIXING DEVICE, IMAGE FORMING APPARATUS, FIXING CONTROL METHOD

(71) Applicant: KYOCERA Document Solutions Inc., Osaka (JP)

(72) Inventors: Einosuke Kikuchi, Osaka (JP); Kuniaki Nakano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 10 days.

(21) Appl. No.: 17/678,656

(22) Filed: Feb. 23, 2022

(65) Prior Publication Data

US 2022/0269199 A1 Aug. 25, 2022

(30) Foreign Application Priority Data

Feb. 24, 2021 (JP) ..... 2021-027181

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2004/0037579 A1* 2/2004 Hashiguchi ..... G03G 15/2064 399/328
2018/0275558 A1* 9/2018 Kondo ..... G03G 15/55
2022/0236674 A1* 7/2022 Kikuchi ..... G03G 15/0266

FOREIGN PATENT DOCUMENTS

JP 2000305388 A 11/2000

* cited by examiner

*Primary Examiner* — Thomas S Giampaolo, II
(74) *Attorney, Agent, or Firm* — Alleman Hall Creasman & Tuttle LLP

(57) ABSTRACT

A fixing device includes a fixing member, a pressurizing member, a charging portion, and a control portion. The fixing member rotates while being heated. The pressurizing member forms a nip portion between itself and a surface of the fixing member in such a way as to hold a sheet therebetween and conveys the sheet by rotating together with the fixing member, wherein an image of toner has been formed on the sheet. The charging portion electrically charges the surface of the fixing member to a polarity that is same as a charging polarity of the toner by supplying a charging current to a pair of electrodes that is disposed to face the surface of the fixing member. The control portion derives an index value of a charge amount of the toner on the sheet, and adjusts the charging current based on the index value.

9 Claims, 3 Drawing Sheets

FIXING DEVICE, IMAGE FORMING APPARATUS, FIXING CONTROL METHOD

INCORPORATION BY REFERENCE

This application is based upon and claims the benefit of priority from the corresponding Japanese Patent Application No. 2021-027181 filed on Feb. 24, 2021, the entire contents of which are incorporated herein by reference.

BACKGROUND

The present disclosure relates to a fixing device, an image forming apparatus, and a fixing control method for preventing occurrence of an offset image by electrically charging a fixing member.

In an electrophotographic image forming apparatus, a fixing device fixes a toner image to a sheet by applying heat and pressure to the toner image formed on the sheet. The fixing device includes a heater, a fixing member, and a pressurizing member.

The fixing member rotates while being heated by the heater. The pressurizing member forms a nip portion between itself and the surface of the fixing member in such a way as to hold the sheet therebetween and conveys the sheet by rotating together with the fixing member.

In the fixing device, an offset image may be formed on the sheet when the fixing member is electrically charged to a polarity that is reverse to the charging polarity of the toner. The offset image is a noise image that is generated when a part of the toner on the sheet is electrically attracted to the surface of the fixing member and then transferred from the fixing member to the sheet.

On the other hand, the fixing device may include a charging portion that electrically charges, by electric discharge, the surface of the fixing member to a polarity that is the same as the charging polarity of the toner. By the action of the charging portion, the offset image is prevented from being formed.

SUMMARY

A fixing device according to an aspect of the present disclosure includes a fixing member, a pressurizing member, a charging portion, and a control portion. The fixing member rotates while being heated. The pressurizing member forms a nip portion between itself and a surface of the fixing member in such a way as to hold a sheet therebetween and conveys the sheet by rotating together with the fixing member, wherein an image of toner has been formed on the sheet. The charging portion electrically charges the surface of the fixing member to a polarity that is same as a charging polarity of the toner by supplying a charging current to a pair of electrodes that is disposed to face the surface of the fixing member. The control portion derives an index value of a charge amount of the toner on the sheet, and adjusts the charging current based on the index value.

An image forming apparatus according to another aspect of the present disclosure includes an image creating portion, a transfer portion, and the fixing device. The image creating portion creates the image of the toner. The transfer portion transfers the image of the toner to the sheet.

A fixing control method according to a further aspect of the present disclosure controls a fixing device that includes the fixing member, the pressurizing member, and the charging portion. The fixing control method includes a processor deriving an index value of a charge amount of the toner on the sheet. The fixing control method further includes the processor adjusting the charging current based on the index value.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment executes a print process to form an image on a sheet 9 by an electrophotographic method.

Figure 1:
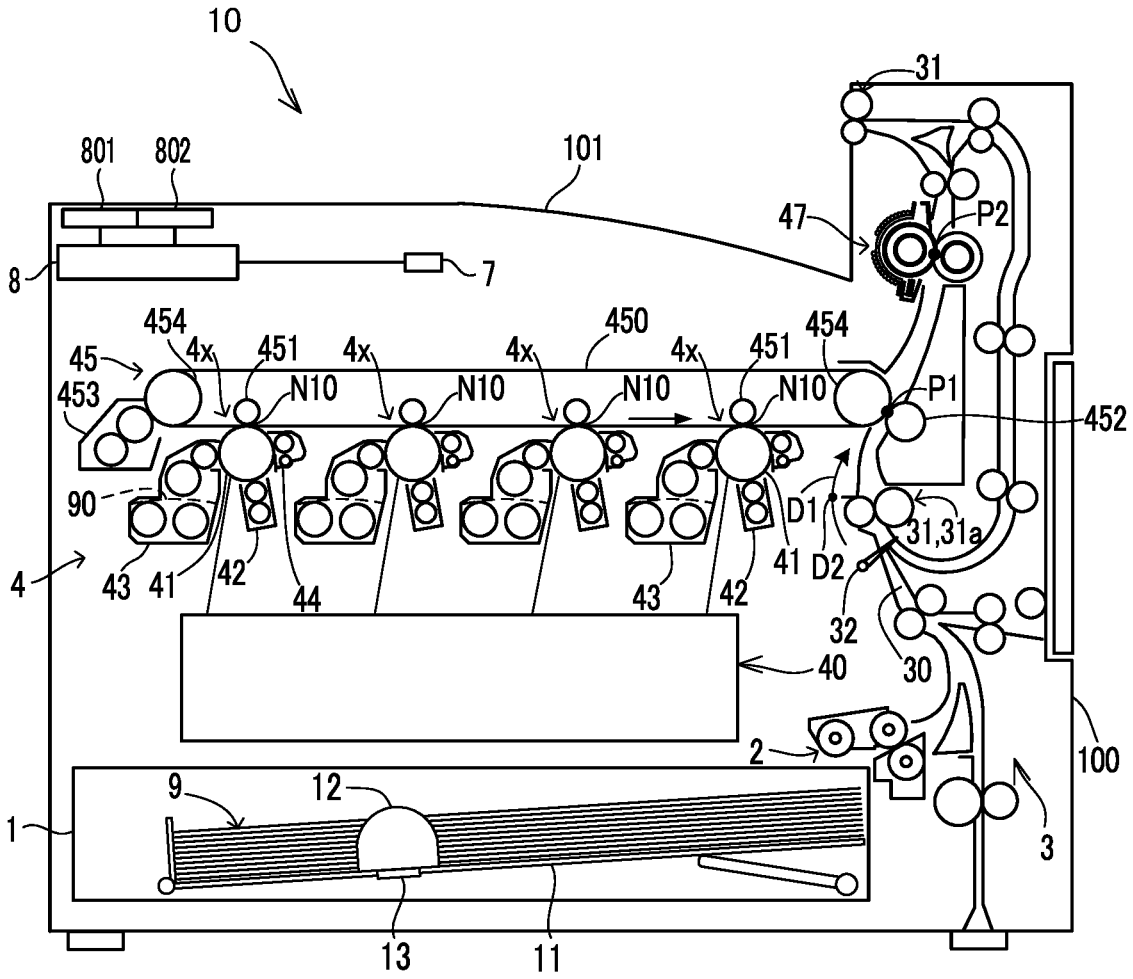
FIG. 1 is a configuration diagram of an image forming apparatus according to an embodiment.

As shown in FIG. 1, the image forming apparatus 10 includes a sheet storage portion 1, a sheet feed-out device 2, a sheet conveying device 3, an image creating device 4, a transfer device 45, a fixing device 47, a control device 8, an operation device 801, and a display device 802. The sheet storage portion 1, the sheet feed-out device 2, the sheet conveying device 3, the image creating device 4, the transfer device 45, the fixing device 47, and the control device 8 are stored in a main body portion 100 that is a housing.

In the following description, a direction in which the sheet 9 is conveyed, is referred to as a conveyance direction D1. In addition, a direction crossing the conveyance direction D1 is referred to as a width direction D2. The width direction D2 is perpendicular to the conveyance direction D1.

The sheet storage portion 1 stores sheets 9 that are to be conveyed to the transfer device 45. The sheet storage portion 1 includes a sheet mounting portion 11 on which the sheets 9 are mounted, and a pair of sheet cursors 12. The pair of sheet cursors 12 are provided at opposite sides of the sheets 9 mounted on the sheet mounting portion 11 in such a way as to move along the width direction D2.

Specifically, the pair of sheet cursors 12 are moved symmetrically along the width direction D2 by a rack and pinion mechanism (not shown).

The pair of sheet cursors 12 are placed along opposite ends of the sheets 9 in the width direction D2. This allows the sheets 9 to be positioned in the width direction D2 by the pair of sheet cursors 12.

The sheet feed-out device 2 feeds out the top-most one of a plurality of sheets 9 mounted on the sheet mounting portion 11 toward a conveyance path 30 provided in the main body portion 100.

The sheet conveying device 3 includes a plurality of pairs of conveyance rollers 31 and a sheet sensor 32. The plurality of pairs of conveyance rollers 31 is located in the conveyance path 30 in such a way as to convey a sheet 9 along the conveyance path 30 by rotating while holding the sheet 9 between rollers of each pair. The rear most pair of the plurality of pairs of conveyance rollers 31 discharges the sheet 9 from the conveyance path 30 to a discharge tray 101.

The plurality of pairs of conveyance rollers 31 includes a pair of resist rollers 31*a* that is disposed upstream of the transfer device 45 in the conveyance direction D1 in the conveyance path 30. The pair of resist rollers 31*a* temporarily stops the sheet 9 that has been conveyed from a preceding pair of rollers 31, and then starts to convey the sheet 9 at a predetermined timing toward a transfer position P1 in the conveyance path 30.

The sheet sensor 32 detects the sheet 9 at a position upstream of the pair of resist rollers 31*a* in the conveyance direction D1 in the conveyance path 30. It is noted that the position upstream of the pair of resist rollers 31*a* in the conveyance direction D1 is an example of a position upstream of the fixing device 47 in the conveyance direction D1.

The pair of resist rollers 31*a* is started after a predetermined time elapses since the sheet sensor 32 detects the sheet 9 in a state where the pair of resist rollers 31*a* is stopping. This adjusts the timing when the sheet 9 is conveyed toward the transfer position P1.

The image creating device 4 executes an image creating process to create an image of toner 90 on the surface of a photoconductor 41. In the present embodiment, the image forming apparatus 10 is a tandem-type color printer.

Accordingly, the image creating device 4 includes a laser scanning unit 40 and a plurality of single-color image creating portions 4*x* that corresponds to a plurality of developing colors. In the example shown in FIG. 1, the image creating device 4 includes four single-color image creating portions 4*x* that respectively correspond to four colors of toner 90: yellow; magenta; cyan; and black.

Each of the single-color image creating portions 4*x* includes a drum-like photoconductor 41, a drum charging device 42, a developing device 43, and a drum cleaning device 44. The image creating device 4 is an example of an image creating portion.

In each of the single-color image creating portions 4*x* that execute the image creating process, the photoconductor 41 rotates and the drum charging device 42 electrically charges the surface of the photoconductor 41. Furthermore, the laser scanning unit 40 scans a laser beam on the electrically charged surfaces of the photoconductors 41, thereby writing an electrostatic latent image on each of the surfaces of the photoconductors 41.

By the action of the drum charging devices 42 and the laser scanning unit 40, the electrostatic latent images that represent single-color images respectively corresponding to the developing colors are formed on the surfaces of the photoconductors 41.

Furthermore, in each of the single-color image creating portions 4*x*, the developing device 43 develops the electrostatic latent image as the image of the toner 90 by supplying the toner 90 to the photoconductor 41 on which the electrostatic latent image has been formed.

With the above-described operation, the images of the toner 90 representing the single-color images are formed on the surfaces of the photoconductors 41. During the image creating process, the photoconductors 41 rotate while carrying the images of the toner 90 that respectively correspond to the single-color images.

At the transfer position P1 in the conveyance path 30, the transfer device 45 transfers the images of the toner 90 from the surfaces of the four photoconductors 41 to the sheet 9. Furthermore, the transfer device 45 conveys the sheet 9 toward a fixing position P2 in the conveyance path 30. The transfer device 45 is an example of a transfer portion.

In the tandem-type image forming apparatus 10, the transfer device 45 includes four primary transfer rollers 451, an intermediate transfer belt 450, a secondary transfer roller 452, and a belt cleaning device 453, wherein the four primary transfer rollers 451 correspond to the four photoconductors 41. The intermediate transfer belt 450 has an endless shape and is rotatably supported by a plurality of support rollers 454.

The four primary transfer rollers 451, while rotating, transfer images of the toner 90 respectively from the four photoconductors 41 to the intermediate transfer belt 450. This allows the images of the toner 90 of four colors to be combined into a color image that is formed on the intermediate transfer belt 450. The color image is a combination image of the four single-color images, and is a print-target image.

In each of the single-color image creating portions 4*x*, the drum cleaning device 44 removes and collects, from the photoconductor 41, toner 90 that has remained on the photoconductor 41 without being transferred to the intermediate transfer belt 450.

The secondary transfer roller 452 transfers the images of the toner 90 of the four colors from the intermediate transfer belt 450 to the sheet 9. It is noted that in the image forming apparatus 10, the four photoconductors 41 and the intermediate transfer belt 450 of the transfer device 45 are each an example of an image carrier that rotates while carrying an image of the toner 90.

The belt cleaning device 453 removes and collects, from the intermediate transfer belt 450, toner that has remained on the intermediate transfer belt 450 without being transferred to the sheet.

At the fixing position P2, the fixing device 47 applies heat and pressure to the image of the toner 90 that has been transferred to the sheet 9. In this way, the fixing device 47 fixes the image of the toner 90 to the sheet 9.

Figure 2:
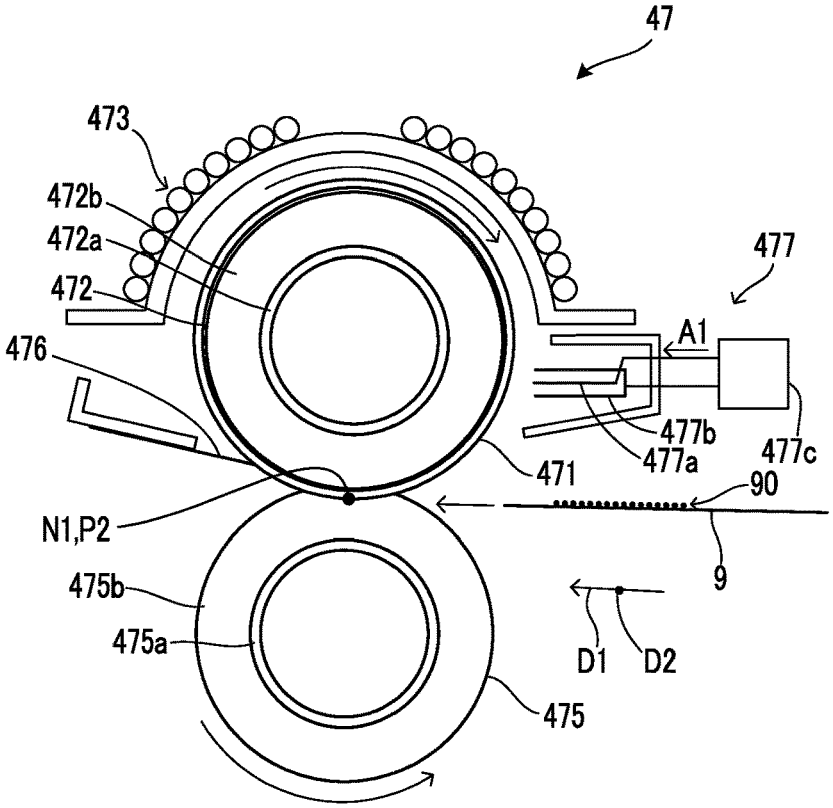
FIG. 2 is a configuration diagram of a fixing device included in the image forming apparatus according to the embodiment.

As shown in FIG. 2, the fixing device 47 includes a fixing belt 471, a fixing roller 472, a heater 473, a pressurizing roller 475, and a sheet separating member 476.

The fixing belt 471 is a flexible tubular member and includes the fixing roller 472 therein. The fixing belt 471 is heated by the heater 473.

The fixing roller 472 is a tubular member supporting the fixing belt 471 at its inside. The fixing roller 472 includes a tubular metal core portion 472*a* and an elastic portion 472*b* that is formed on the outer periphery of the metal core portion 472*a*. It is noted that the fixing roller 472 is an example of a support body that supports the fixing belt 471.

The fixing roller 472 is rotatably supported. The fixing belt 471 is configured to rotate together with the fixing roller 472.

In the present embodiment, the fixing belt 471 includes a conductive substrate, an elastic layer formed on the outer periphery of the substrate, and a release layer formed on the outer periphery of the elastic layer. In the fixing belt 471, the substrate is made of a metal mainly composed of nickel or the like, the elastic layer is made of silicon rubber, foamed resin or the like, and the release layer is made of resin such as polytetrafluoroethylene.

The heater 473 is disposed to face the outer peripheral surface of the fixing belt 471. In the present embodiment, the heater 473 is an electromagnetic induction heating type heating device. The heater 473 mainly heats the substrate of the fixing belt 471 by the electromagnetic induction.

The pressurizing roller 475 is rotatably supported and forms a nip portion N1 between itself and the surface of the fixing belt 471, wherein at the nip portion N1, the sheet 9 on which the image of the toner 90 has been formed is held between the pressurizing roller 475 and the fixing belt 471. The position of the nip portion N1 is the fixing position P2.

Similar to the fixing roller 472, the pressurizing roller 475 includes a tubular metal core portion 475*a* and an elastic portion 475*b* that is formed on the outer periphery of the metal core portion 475*a*. In addition, a release layer made of resin such as polytetrafluoroethylene is formed on the outer peripheral surface of the elastic portion 475*b*.

The metal core portion 472*a* of the fixing roller 472 and the metal core portion 475*a* of the pressurizing roller 475 are made of, for example, a metal mainly composed of aluminum or iron. In addition, the elastic portion 472*b* of the fixing roller 472 and the elastic portion 475*b* of the pressurizing roller 475 are made of silicon rubber, foamed resin or the like.

The pressurizing roller 475 is rotationally driven by a drive mechanism (not shown). The fixing belt 471 and the fixing roller 472 rotate in conjunction with the pressurizing roller 475. The pressurizing roller 475 conveys the sheet 9 by rotating together with the fixing belt 471.

The fixing belt 471 heats the image of the toner 90 formed on the sheet 9, and the pressurizing roller 475 pressurizes the image of the toner 90 toward the sheet 9. This allows the image of the toner 90 to be fixed to the sheet 9.

It is noted that the fixing belt 471 is an example of a fixing member that rotates while being heated. The fixing roller 472 is an example of a support member that is disposed inside the fixing belt 471. The pressurizing roller 475 is an example of a pressurizing member.

The fixing device 47 further includes a fixing charging device 477. The fixing charging device 477 includes a charging probe 477*a*, a shield member 477*b*, and a current output circuit 477*c*.

The charging probe 477*a* and the shield member 477*b* are conductive members disposed to face the surface of the fixing belt 471. The current output circuit 477*c* causes a charging current A1 to flow by applying a voltage to the charging probe 477*a* and the shield member 477*b*.

The charging probe 477*a* and the shield member 477*b* are disposed at a small interval. The charging current A1 is caused to flow between the charging probe 477*a* and the shield member 477*b* by electric discharge.

The fixing charging device 477 electrically charges the surface of the fixing belt 471 to a polarity that is the same as the charging polarity of the toner 90 by supplying the charging current A1 to the charging probe 477*a* and the shield member 477*b*. In the present embodiment, the charging polarity of the toner 90 is positive. The charging probe 477*a* and the shield member 477*b* are an example of a pair of electrodes. The fixing charging device 477 is an example of a charging portion.

The fixing charging device 477 is configured to prevent an offset image from being formed on the sheet 9 when the fixing belt 471 is charged to a polarity that is reverse to the charging polarity of the toner 90.

The operation device 801 is configured to receive human operations, and, for example, includes operation buttons and a touch panel. The display device 802 is configured to display information, and, for example, is a panel display device such as a liquid crystal display panel.

Figure 3:
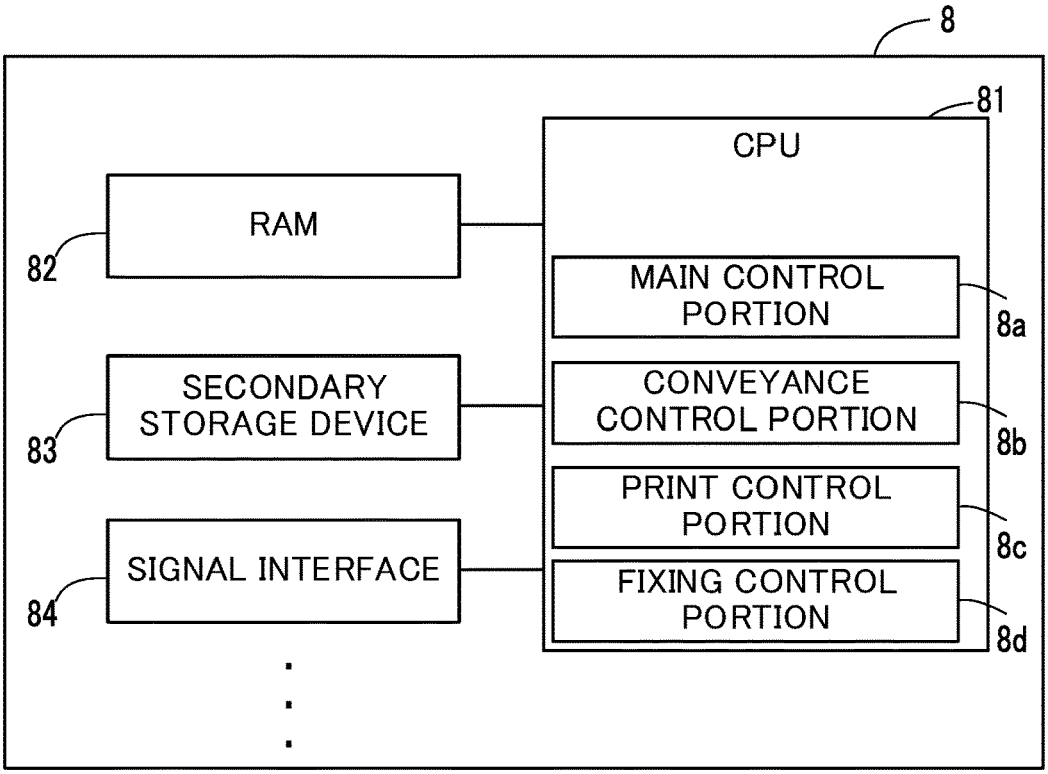
FIG. 3 is a block diagram showing a configuration of a control device included in the image forming apparatus according to the embodiment.

As shown in FIG. 3, the control device 8 includes a CPU (Central Processing Unit) 81 and peripheral devices such as a RAM (Random Access Memory) 82, a secondary storage device 83, and a signal interface 84.

The CPU 81 is a processor that executes various types of data processing and controls by executing computer programs. The RAM 82 is a computer-readable volatile storage device. The RAM 82 primarily stores the computer programs executed by the CPU 81, and data that is output and consulted by the CPU 81 during execution of the various types of processing.

The secondary storage device 83 is a computer-readable nonvolatile storage device. The secondary storage device 83 is configured to store and update the computer programs and various types of data. For example, either or both of a flash memory and a hard disk drive are adopted as the secondary storage device 83.

The signal interface 84 is configured to convert signals output from various types of sensors to digital data, and transmit the digital data to the CPU 81. Furthermore, the signal interface 84 is configured to convert a control command output from the CPU 81 to a control signal and transmit the control signal to a control-target device.

The CPU 81 includes a plurality of processing modules that is realized when the computer programs are executed. The plurality of processing modules includes a main control portion 8*a*, a conveyance control portion 8*b*, a print control portion 8*c*, and a fixing control portion 8*d*.

The main control portion 8*a* executes a control to start any one of the various types of processing in accordance with an operation performed on the operation device 801, and executes a control of the display device 802.

The conveyance control portion 8*b* controls the sheet feed-out device 2 and the sheet conveying device 3. When a print process is executed, the conveyance control portion 8*b* causes the plurality of pairs of conveyance rollers 31 to operate and causes the sheet feed-out device 2 to operate for a predetermined time period. This allows the top-most sheet 9 in the sheet storage portion 1 to be fed toward the conveyance path 30 and conveyed toward the pair of resist rollers 31*a*.

Furthermore, the conveyance control portion 8*b* temporarily stops the pair of resist rollers 31*a* at a timing that is determined based on a time point when the sheet 9 is detected by the sheet sensor 32, and then restarts the pair of resist rollers 31*a*.

The print control portion 8*c* causes the image creating device 4 to create an image of the toner 90 in synchronization with the conveyance of the sheet 9 by the sheet conveying device 3.

The fixing control portion 8*d* controls the heater 473 and the fixing charging device 477 of the fixing device 47. The fixing control portion 8*d* constitutes a part of the fixing device 47.

Specifically, the fixing control portion 8*d* controls power of the heater 473 so that a temperature detected by a fixing temperature sensor (not shown) becomes a predetermined target temperature. The fixing temperature sensor is configured to detect the temperature of the fixing belt 471.

Furthermore, the fixing control portion 8*d* causes the current output circuit 477*c* to output the charging current A1 when the sheet 9 passes the fixing position P2.

The secondary storage device 83 is a computer-readable nonvolatile storage device. The secondary storage device 83 is configured to store and update the computer programs and various types of data. For example, either or both of a flash memory and a hard disk drive are adopted as the secondary storage device 83.

The signal interface 84 is configured to convert signals output from various types of sensors such as the sheet sensor 32 to digital data, and transmit the digital data to the CPU 81. Furthermore, the signal interface 84 is configured to convert a control command output from the CPU 81 to a control signal and transmit the control signal to a control-target device.

Meanwhile, it is known that, in the fixing device 47, a volatile component is released due to the heat generated by the heater 473. In addition, it has been confirmed that the amount of the volatile component is increased due to the electric discharge performed by the fixing charging device 477.

An effective way to suppress generation of the volatile component is to suppress a discharged charge amount of the fixing charging device 477, namely, to minimize the charging current A1 output from the fixing charging device 477 as small as possible. On the other hand, when the charging current A1 is excessively small, the fixing charging device 477 fails to sufficiently charge the surface of the fixing charging device 477, thereby causing the offset image to occur.

In the present embodiment, the fixing control portion 8*d* executes a charging current control to suppress an amount of released volatile component while preventing occurrence of the offset image. The charging current control is described below. The charging current control executed by the fixing control portion 8*d* is an example of a fixing control method.

Here, a relationship among the charging current A1, the size of the sheet 9, and a belt surface potential V1 is described with reference to FIG. 4. The belt surface potential V1 is the surface potential of the fixing belt 471.

Figure 4:
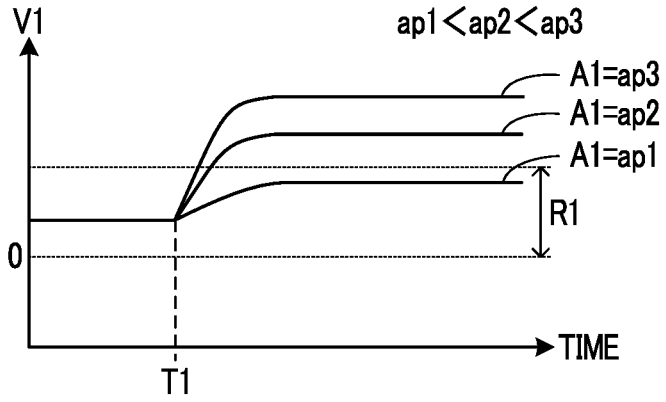
FIG. 4 is a diagram showing an example of change of a surface potential of a fixing belt when a charging current is output in the fixing device.

The graph of FIG. 4 shows an example of change of the belt surface potential V1 when the charging current A1 is output in the fixing device 47. In FIG. 4, T1 represents a charging start time point T1 that is a time point when a predetermined charging current A1 starts to flow in the fixing device 47 in operation.

In FIG. 4, R1 represents a target potential range R1 that is a target range of the belt surface potential V1 required to suppress the amount of released volatile component while preventing occurrence of the offset image.

The graph of FIG. 4 shows that, as the charging current A1 becomes larger, the rising speed of the belt surface potential V1 becomes higher, and the belt surface potential V1 becomes higher. This indicates that when the charging current A1 is excessively large, the belt surface potential V1 exceeds the target potential range R1, and the amount of released volatile component increases.

On the other hand, the offset image is less likely to occur when a charge amount of the toner 90 on the sheet 9 is large than when the charge amount of the toner 90 is small. Accordingly, it is possible to suppress an amount of released volatile component while preventing occurrence of the offset image, by adjusting the charging current A1 to be relatively small when the charge amount of the toner 90 on the sheet 9 is large.

In view of the above, in the charging current control, the fixing control portion 8*d* derives a charging index value that is an index value of the charge amount of the toner 90 on the sheet 9. Furthermore, the fixing control portion 8*d* adjusts the charging current A1 based on the charging index value by controlling the current output circuit 477*c*.

For example, the fixing control portion 8*d* derives the charging index value based on the amount of the toner 90 on the sheet 9 for each color.

Specifically, the fixing control portion 8*d* derives, as a single-color toner amount representing an amount of the toner 90 for each of the developing colors, the number of drawing pixels for each of the developing colors in the print-target image. This allows the single-color toner amount to be derived for each of yellow, magenta, cyan, and black.

However, to begin with, the offset image hardly occurs with regard to a developing color for which the single-color toner amount is excessively small. Accordingly, the fixing control portion 8*d* removes a single-color toner amount that is smaller than a predetermined lower-limit amount, from parameters that are used to derive the charging index value. In other words, to derive the charging index value, the fixing control portion 8*d* uses single-color toner amounts that are larger than the lower-limit amount.

In addition, the offset image of yellow toner 90 is inconspicuous even when it is formed on the sheet 9. As a result, the lower-limit amount for yellow may be set to be larger than the lower-limit amounts for the other colors. In addition, to begin with, yellow may be removed from the targets for deriving the single-color toner amount.

Furthermore, the fixing control portion 8*d* derives a single-color index value by multiplying each of single-color toner amounts that are larger than the lower-limit amount, by a first correction coefficient for a corresponding developing color, wherein the single-color index value is an index value of the charge amount of the toner 90 for each developing color.

Each time the image of the toner 90 passes through a primary transfer nip N10 that is formed between the primary transfer roller 451 and the photoconductor 41, the charge amount increases. Accordingly, when a developing color passes through the nip portion N1 by a greater number of times, the first correction coefficient corresponding to the developing color is set to be higher.

In general, the image of black toner 90 passes through the nip portion N1 by a smaller number of times than the images of the toner 90 of the other chromatic colors. In this case, the first correction coefficient corresponding to black is set to be lower than the first correction coefficients corresponding to the other chromatic colors.

In addition, the charge amount of the toner 90 tends to be smaller as the surrounding humidity becomes higher. In the present embodiment, the image forming apparatus 10 includes a humidity sensor 7 configured to detect the humidity in the image forming apparatus 10 (see FIG. 1).

Accordingly, the fixing control portion 8*d* may derive the single-color index value for each developing color by multiplying each of the single-color toner amounts by the first correction coefficient for the corresponding developing color and by a second correction coefficient corresponding to the humidity detected by the humidity sensor 7.

In the above-described case, the fixing control portion 8*d* acquires the detected humidity from the humidity sensor 7.

Furthermore, the fixing control portion 8*d* drives the second correction coefficient corresponding to the detected humidity, in accordance with a predetermined setting rule. Here, the fixing control portion 8*d* sets the second correction coefficient to be lower when the detected humidity is high than when the detected humidity is low.

Furthermore, the fixing control portion 8*d* derives the charging index value based on the single-color index values after correction. For example, the fixing control portion 8*d* derives, as the charging index value, the minimum value among the single-color index values after correction. In addition, the fixing control portion 8*d* may derive, as the charging index value, an average value of the single-color index values after correction.

In addition, the fixing control portion 8*d* adjusts the charging current A1 based on the charging index value. For example, the fixing control portion 8*d* determines which of a plurality of ranks the charging index value belongs to by comparing the charging index value with one or more predetermined index thresholds. In this case, the fixing control portion 8*d* adjusts the charging current A1 to a candidate current value that had preliminarily been associated with a rank to which the charging index value is determined to belong.

With the execution of the charging current control, the charging current A1 is adjusted to be relatively small when the offset image is not likely to occur since a charge amount of the image of the toner 90 on the sheet 9 is large. This suppresses an amount of released volatile component. As a result, it is possible to suppress the amount of released volatile component while preventing occurrence of the offset image.

First Application Example

The following describes a first application example of the image forming apparatus 10.

Figure 5:
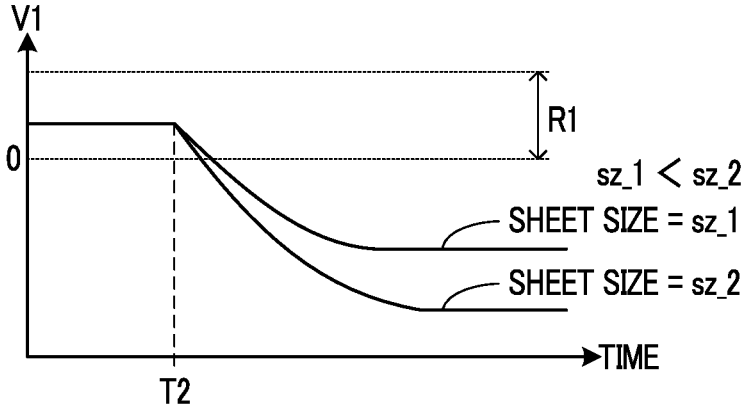
FIG. 5 is a diagram showing an example of change of the surface potential of the fixing belt when a sheet passes through the fixing device.

As shown in FIG. 5, the belt surface potential V1 is influenced by the size of the sheet 9. The graph of FIG. 5 shows an example of change of the belt surface potential V1 when the sheet 9 passes through the fixing device 47.

In FIG. 5, T2 represents a sheet reach time point T2 that is a time point when a tip of the sheet 9 reaches the nip portion N1 of the fixing device 47 when the charging current A1 is not flowing.

The graph of FIG. 5 shows that, as the size of the sheet 9 becomes larger, the falling speed of the belt surface potential V1 becomes higher, and the belt surface potential V1 becomes lower. It is thought that a difference in the size of the sheet 9 corresponds to a difference in the electrostatic capacitance of the sheet 9. As the electrostatic capacitance of the sheet 9 becomes larger, the speed and amount of the charge moving between the fixing belt 471 and the sheet 9 becomes larger.

Accordingly, in a case where the charging current A1 is set in correspondence with a small-size sheet 9, when a large-size sheet 9 passes through the nip portion N1, the belt surface potential V1 may fall below the target potential range R1, and the offset image may be formed.

On the other hand, in a case where the charging current A1 is set in correspondence with the large-size sheet 9, when the small-size sheet 9 passes through the nip portion N1, the belt surface potential V1 may exceed the target potential range R1, and the amount of released volatile component may increase.

In the present application example, the fixing control portion 8*d* acquires size information that indicates the size of the sheet 9 conveyed toward the nip portion N1. For example, the size information includes either or both of length information and width information of the sheet 9.

The length information indicates the size of the sheet 9 in the conveyance direction D1. The width information indicates the size of the sheet 9 in the width direction D2.

Furthermore, in the present application example, the fixing control portion 8*d* adjusts the charging current A1 based on the charging index value and the size information.

Specifically, when the charging index value is equal, the fixing control portion 8*d* adjusts the charging current A1 to be larger when the size of the sheet 9 indicated by the size information is large than when the size of the sheet 9 indicated by the size information is small.

For example, an adjustment data table is prepared preliminarily for each of a plurality of size ranges of the sheet 9, wherein the adjustment data table indicates a correspondence relationship between the plurality of ranks of the charging index value and a plurality of candidate current values of the charging current A1.

For example, the size range is a range of the size indicated by the length information or the width information. In addition, the size range may be a range of the area of the sheet 9 that is derived from the length information and the width information.

In the present application example, the fixing control portion 8*d* adjusts the charging current A1 to a candidate current value that is obtained by applying the charging index value to the adjustment data table that had been prepared for a size range corresponding to the size information.

For example, the fixing control portion 8*d* acquires a detection result of the sheet sensor 32. Furthermore, the fixing control portion 8*d* identifies, as the length information, a time period for which the sheet 9 is detected by the sheet sensor 32 while the pair of resist rollers 31*a* are rotating.

It is noted that the sheet sensor 32 is an example of a sensor that detects the sheet 9 at a position upstream of the fixing device 47 in the conveyance direction D1 in the conveyance path of the sheet 9.

In addition, the image forming apparatus 10 includes a potentiometer 13 that measures the position of the pair of sheet cursors 12 (see FIG. 1). The potentiometer 13 measures the size of the sheet 9 in the width direction D2 by measuring the position of the pair of sheet cursors 12.

The fixing control portion 8*d* acquires the measurement result of the potentiometer 13 as the width information. It is noted that the potentiometer 13 is an example of a width measuring portion that measures the size of the sheet 9 in the width direction D2 by measuring the position of the pair of sheet cursors 12.

Either or both of the length information and the width information of the sheet 9 may be input via the operation device 801. In this case, the fixing control portion 8*d* acquires a part or all of the size information via the operation device 801.

With the adoption of the present application example, a similar effect is obtained as in the case where the image forming apparatus 10 according to the embodiment is adopted.

Second Application Example

The following describes a second application example of the image forming apparatus 10.

The offset image is more likely to occur when the image of the toner 90 on the sheet 9 is a dot image than when the image is a solid image. In other words, the offset image is more likely to occur when the toner density on the sheet 9 is low than when the toner density is high. The toner density is the density of the image of the toner 90 on the sheet 9.

In the present application example, the fixing control portion 8*d* adjusts the charging current A1 based on the charging index value and density information that indicates the toner density.

For example, the fixing control portion 8*d* derives, as a unit toner density, for each of a plurality of predetermined unit areas in the print-target image, the number of drawing pixels for each of the developing colors in the unit area, or an occupancy ratio of drawing pixels in the unit area.

To begin with, the offset image hardly occurs with regard to a developing color for which the unit toner density is excessively low.

The fixing control portion 8*d* derives, as the density information for each of the developing colors, the minimum value that exceeds a predetermined lower-limit density among the unit toner densities of the unit areas, for each of the developing colors.

In the present application example, the fixing control portion 8*d* adjusts the charging current A1 based on the charging index value and the density information.

Specifically, when the charging index value is equal, the fixing control portion 8*d* adjusts the charging current A1 to be larger when the density indicated by the density information is high than when the density indicated by the density information is low.

For example, the adjustment data table is prepared preliminarily for each of a plurality of density ranges, wherein the adjustment data table indicates a correspondence relationship between the plurality of ranks of the charging index value and a plurality of candidate current values of the charging current A1. In this case, the fixing control portion 8*d* adjusts the charging current A1 to a candidate current value that is obtained by applying the charging index value to the adjustment data table that had been prepared for a density range corresponding to the density information.

In addition, the present application example may be applied to the first application example. In this case, the adjustment data table is prepared preliminarily for each combination of the plurality of size ranges and the plurality of density ranges of the sheet 9.

The fixing control portion 8*d* adjusts the charging current A1 to a candidate current value that is obtained by applying the charging index value to the adjustment data table that had been prepared for a combination of: a size range corresponding to the size information; and a density range corresponding to the density information.

With the adoption of the present application example, a similar effect is obtained as in the case where the image forming apparatus 10 according to the embodiment is adopted.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing member configured to rotate while being heated;

a pressurizing member that forms a nip portion between itself and a surface of the fixing member in such a way as to hold a sheet therebetween and conveys the sheet by rotating together with the fixing member, wherein an image of toner has been formed on the sheet;

a fixing charging device configured to electrically charge the surface of the fixing member to a polarity that is the same as a charging polarity of the toner by supplying a charging current to a pair of electrodes that is disposed to face the surface of the fixing member; and a control portion configured to derive a plurality of single-color index values for each of a plurality of developing colors, respectively, in the image of toner based on a number of drawing pixels for each of the plurality of developing colors, and adjust the charging current based on the single-color index values for each of the plurality of developing colors, respectively.

2. The fixing device according to claim 1, wherein the control portion derives the plurality of single-color index values for each of the plurality of developing colors, respectively, in the image of toner by correcting the number of drawing pixels for each of the plurality of developing colors with a first correction coefficient for each of the plurality of developing colors.

3. The fixing device according to claim 1, wherein the control portion derives, for each of a plurality of predetermined unit areas in the image of toner, a unit toner density which is the number of drawing pixels for each of the plurality of developing colors or an occupancy ratio of the drawing pixels, and adjusts the charging current based on the single-color index value for each of the plurality of developing colors and the unit toner density for each of the plurality of developing colors.

4. The fixing device according to claim 1, wherein the fixing member is a flexible tubular member and is supported by a support member that is disposed inside the fixing member.

5. An image forming apparatus comprising:

an image creating device configured to create the image of the toner;

a transfer device configured to transfer the image of the toner to the sheet; and the fixing device according to claim 1.

6. The fixing device according to claim 1, wherein the control portion adjusts the charging current based on a minimum value or an average value of the plurality of single-color index values for each of the plurality of developing colors, respectively.

7. The fixing device according to claim 6, wherein the control portion derives the single-color index value for each of the plurality of developing colors by correcting, with a first correction coefficient for each of the plurality of developing colors, the number of drawing pixels exceeding a lower limit value determined for each of the plurality of developing colors among a plurality of numbers of drawing pixels for each of the plurality of developing colors.

8. The fixing device according to claim 1, wherein the control portion derives the single-color index values for each of the plurality of developing colors, respectively, by correcting the number of drawing pixels for each of the plurality of developing colors with a first correction coefficient for each of the plurality of developing colors.

9. A fixing control method for controlling a fixing device that includes:

a fixing member configured to rotate while being heated;

a pressurizing member that forms a nip portion between itself and a surface of the fixing member in such a way as to hold a sheet therebetween and conveys the sheet by rotating together with the fixing member, wherein an image of toner has been formed on the sheet; and a fixing charging device configured to electrically charge the surface of the fixing member to a polarity that is the same as a charging polarity of the toner by supplying a charging current to a pair of electrodes that is disposed to face the surface of the fixing member, the fixing control method comprising:

a processor deriving a plurality of single-color index values for each of a plurality of developing colors, respectively, in the image of toner based on a number of drawing pixels for each of the plurality of developing colors; and the processor adjusting the charging current based on the single-color index values for each of the plurality of developing colors, respectively.

* * * * *